United States Patent [19]

Bellis

[11] 4,080,888

[45] Mar. 28, 1978

[54] AUTOMATIC SPLICE RELIEF CONTROL

[75] Inventor: John Louis Bellis, Ansonia, Conn.

[73] Assignee: USM Corporation, Boston, Mass.

[21] Appl. No.: 719,375

[22] Filed: Sep. 1, 1976

[51] Int. Cl.[2] ..... B30B 15/14

[52] U.S. Cl. ..... 100/47

[58] Field of Search ..... 100/47; 226/11, 35; 250/231 SE

[56] References Cited

U.S. PATENT DOCUMENTS

| | | | |
|---|---|---|---|
| 3,317,734 | 5/1967 | Martin, Jr. | 226/11 X |
| 3,521,551 | 7/1970 | Boxmeyer | 100/47 |
| 3,742,486 | 6/1973 | Skidmore | 250/231 SE |

*Primary Examiner*—Edward J. McCarthy

*Attorney, Agent, or Firm*—Donald N. Halgren; Richard B. Megley; Vincent A. White

[57] ABSTRACT

A calender roll is arranged to automatically have the pressure relieved between a pair of pressure rolls when a splice is detected in a moving web. The splice in the web is detected a known distance upstream of the pressure rolls. A counter, related to web travel distance, is activated to cause the temporary relief in the pressure between the rolls as the splice travels therebetween, preventing any damage that would otherwise occur to the moving web and avoiding any production slowdown.

1 Claim, 2 Drawing Figures

AUTOMATIC SPLICE RELIEF CONTROL

BACKGROUND OF THE INVENTION

1. Field of the Invention

This invention relates to machines utilizing pressure rolls to alter a material passing therebetween, and more specifically, to a calender roll machine for processing a continuous web of tire cord.

2. Prior Art

It is the current practice, in the manufacture of webbing, especially for tire cords, to notice visually any splice or juncture in that webbing by the machine operator as it is pressed and coated with rubber in the machine prior to its being taken into the calender rolls. The machine has to be slowed down, or stopped, and the rolls drawn apart by manual control of the operator. This procedure slows down the manufacture of the web or cord and promotes excessive waste in the cord which is improperly processed. If this operation is not even manually done, the cord would break and much worse efficiency would befall the operation.

U.S. Pat. No. 3,688,958 describes a machine that senses breakage in a running thread. The machine described, however, is stopped at the time of sensing in a manner that would be uneconomic and inefficient for the manufacture of tire cord. U.S. Pat. No. 3,854,643 describes a splice finder in a continuous magnetic tape, but at the point of actual processing, which would be too late in the operational sequence for webbing, such as tire cords being pressed and coated. U.S. Pat. No. 3,949,856 describes a system to detect abnormalities in paper feed arrangements in printers, but are not suggestive of use with the manufacture of webs of tire cords that are being coated with rubber and pressed in calender rolls.

It is an object of the present invention to provide a calender roll machine for the automatic manufacture of tire cord which will operate efficiently, at constant speed.

SUMMARY OF THE INVENTION

This invention comprises a calender roll machine wherein a pair of contiguous rolls which press a continuous web are adapted to be relieved of pressure therebetween in response to a signal from a detection arrangement upstream of the pressure rolls. The signal is sent in response to a splice in a traveling web passing adjacent the detection arrangement. A counter is activated that causes the rolls to relieve their pressure nip temporarily only during passage of the splice therebetween. The period of automatic pressure relief avoids waste and inefficiency that would otherwise occur if the rolls were not permitted to be easily pushed apart by the moving splice, or if they were moved apart manually.

DESCRIPTION OF THE DRAWINGS

The objects and advantages of the present invention will become more apparent when viewed in conjunction with the following drawings in which.

DESCRIPTION OF THE PREFERRED EMBODIMENT

Figure 1:
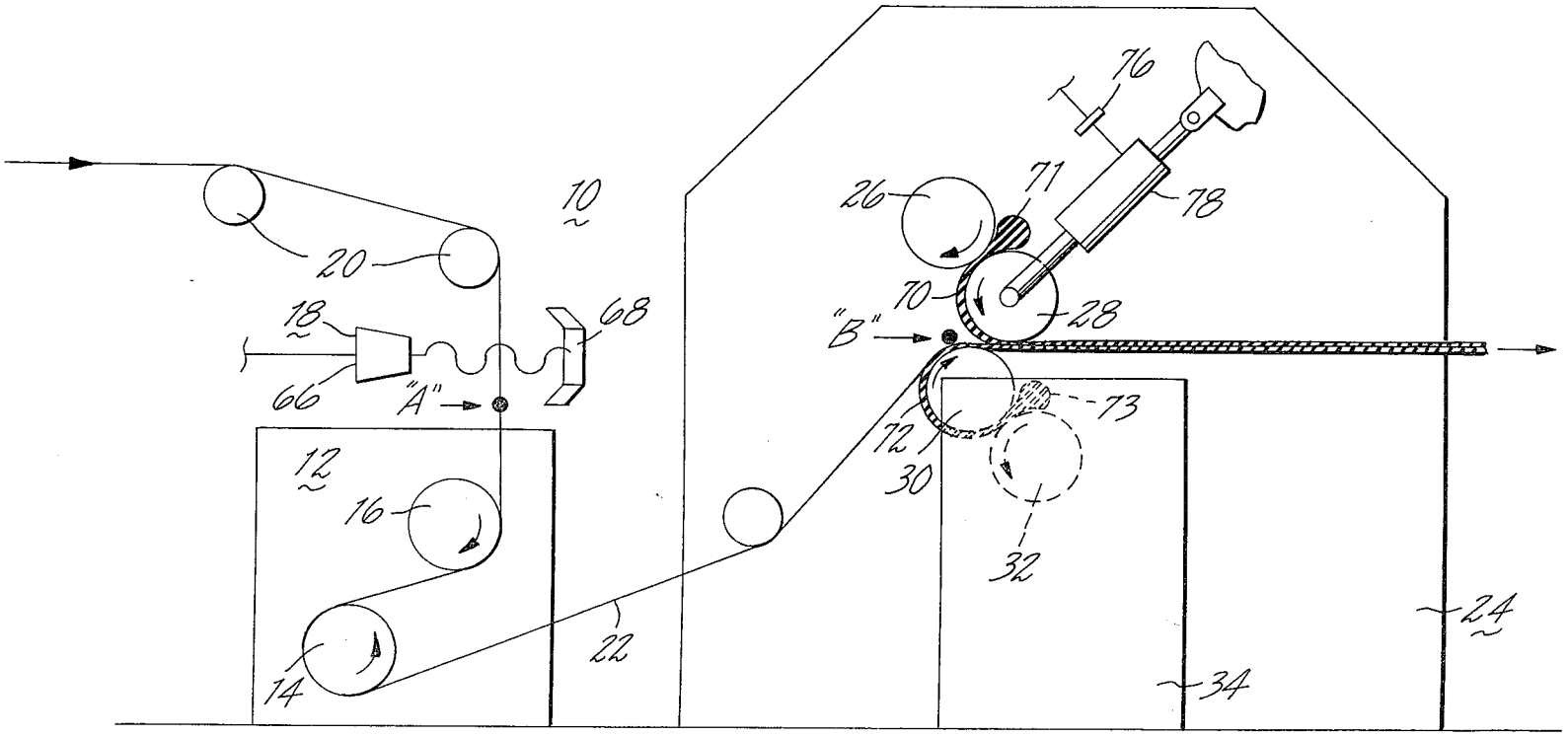
FIG. 1 is a schematic side view of a machine embodying the invention.

Referring to the drawings, and particularly to FIG. 1, there is shown a schematic side view of a calender roll machine apparatus 10, including pre-calendering equipment 12 which is comprised of alignment rolls 14 and 16, a splice detector 18 and a plurality of web supporting rolls 20 which carry a flexible web 22 of indeterminate length, having random splices therein, the web to be processed in a calender roll machine 24.

Figure 2:
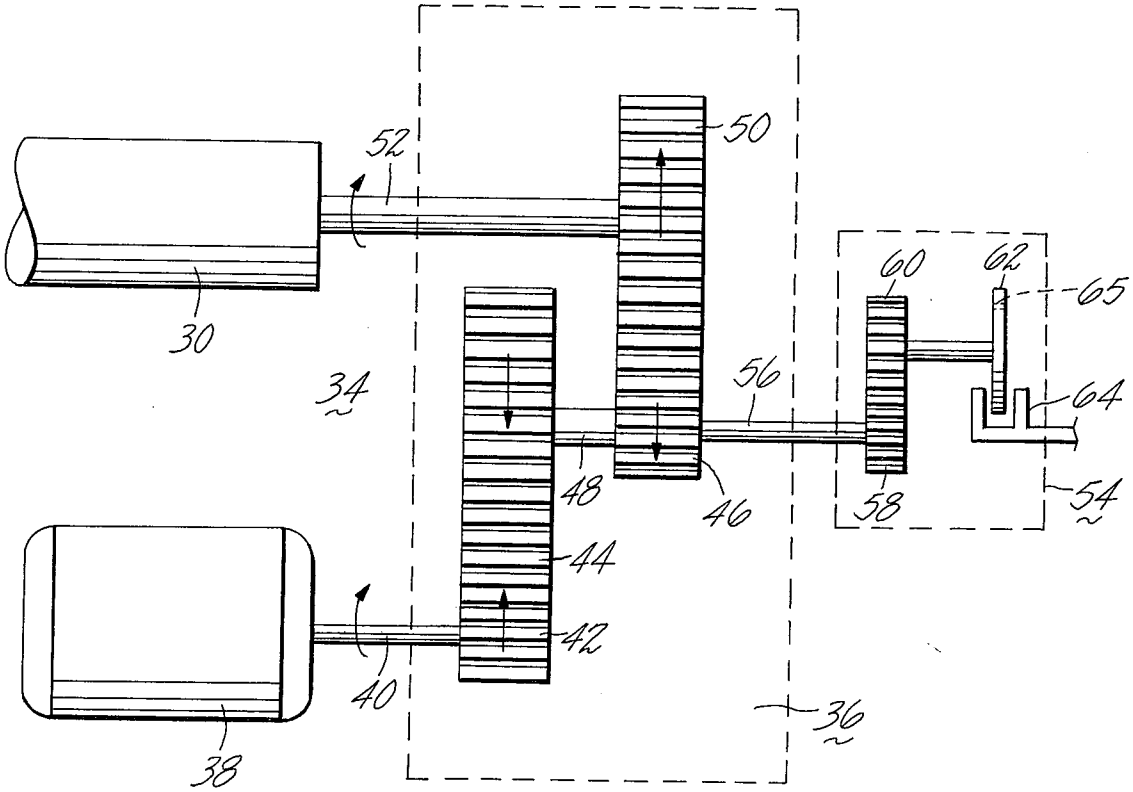
FIG. 2 is a representation of the gearing between a motor, one of a pair of coacting rolls and a portion of a counter arrangement.

The calender roll machine 24 includes an upper roll 26, a pressure relievable roll 28, an intermediate roll 30 and a lower roll 32, each of which may be driven by a type of motor arrangement 34. An example of a typical motor arrangement 34 is shown in FIG. 2, which also shows a calender gear drive mechanism 36 actuated by a motor 38. The drive mechanism 36 is linked to the motor 38 by a first drive shaft 40. The first drive shaft 40 is connected to a first pinion gear 42 engaged with a first spur gear 44. The first gear 44 is connected to a second pinion gear 46 through a second drive shaft 48. The second pinion gear 46 is engaged with a second spur gear 50. The second spur gear 50 is connected with one of the driven rolls, in this example, intermediate roll 30, by a third drive shaft 52.

A counter mechanism is associated with the intermediate roll 30. The counter mechanism 54 is driven from the second pinion gear 46 through a fourth drive shaft 56 connected to a third pinion gear 58. The pinion gear 58 is meshed with a third spur gear 60. A rotatable counter disc 62 is attached to the third spur gear 60. The counter disc 62 typically may have a fiber-optic counter 64 in registration with it. The counter disc 62, shown typically, is 5 inches in diameter and has 32 holes 65 evenly spaced adjacent its periphery and are tabulated in direct proportion to travel distance of the web.

The fiber-optic counter 64 is in activatable communication with an actuator, such as solenoid 76, that causes pressure relief in an arrangement of bias producing pressurizable cylinders 78, as shown in FIG. 1. The pressurizable cylinders 78 cause the pressurizable bias or pressure nip between the pressure relievable roll 28 and the intermediate roll 30. The fiber-optic counter 64 is also in communication with, and is itself activated by, a signal from the splice detector 18. The splice detector 18 may be comprised of a photo-electirc control 66 and a reflector 68. The control 66 may use light emitting diodes to reduce the probability of light failure. The web 22 passes between the photo-electirc control 66 and the reflector 68 in a generally vertical orientation to reduce any particulate buildup which might interfere with the operation of the splice detector 18.

The calender roll apparatus 10 operates by having the fabric or web 22 pass over a series of rolls 20, and then pass generally vertically between the photo-electirc control unit 66 and the reflector 68 which comprises the splice detector 18. The web 22 continues to pass between some alignment and tensioning rolls 14 and 16. The web continues into the calender machine 24 over the rotatable intermediate roll 30. A layer of rubber 70 may be drawn from an upper rubber bank 71 between a nip created by the upper roll 26 and the pressure relievable roll 28 and pressed onto the top surface of the travelling web 22. Another layer of rubber 72 may be drawn from a lower rubber bank 73 between a nip created by intermediate roll 30 and lower roll 32 and deposited on the bottom side of the traveling web 22 as it passes between the pressure releasable roll 28 and intermediate roll 30.

When a splice passes in the web 22 between the photo-electirc control unit 66 and the reflector 68 at point A, a signal is sent through an appropriate circuit, not shown, to cause the fiber-optic counter 64 to begin counting the holes 65 in the rotating counter disc 62. Counting of a predetermined number of holes 65 in the disc 62 is equivalent to the linear distance between points A and B, as shown in FIG. 1. The counter then causes the actuation of the solenoid 76 to relieve the pressure in pressurizable cylinders 78. The counter 64 is arranged so that the pressure relief occurs just as the splice is at point B, without slowing the rate of travel of the web 22. The splice passes between the "now pressure relieved" pressurizable roll 28 and the intermediate roll 30, merely causing a slight fluctuation in the pressurizable roll 28. The counter 64, thereafter, reactivates the pressure in the cylinders 78 after a second predetermined count of holes equivalent to passage of the splice between the rolls, by sending a signal through the circuit, not shown, to cause the solenoid 76 to repressurize the cylinders 78, and a full pressure nip in once again created between the rolls 28 and 30.

If the splice had passed between the roll 28 and the roll 30 without any relief of the pressure nip, the web or cord would inevitably break, resulting in costly downtime of the calender roll apparatus 10.

It is to be noted that variations are possible within the apparatus of the present invention without departing from the scope of the invention. For example, the counter disc 62 could be comprised of the spur gear 60 itself. The counter disc drive 54 also could be arranged on one of the other rolls, or be independent of all of them and be regulated according to the known rate of speed of the web 22. Also, the counter could involve transducer arrangements instead of optics. The splice detector 18 could be comprised of a sensing finger which would measure deviations from the flatness or thickness of the traveling web 22.

Thus, it may be realized by one skilled in this art, that modification of the apparatus described are possible without departing from the scope and spirit of the following claims. It is intended that all subject matter contained in the foregoing description or shown in the accompanying drawings, shall be interpreted as illustrative and not in a limiting sense.

Having thus described my invention, what I claim as new and desire to secure by Letters Patent of the United States is:

1. A calender roll machine for processing indeterminate lengths of flexible web having splices randomly disposed therein, said calender roll machine comprising:

at least two rotatable rolls for pressing said flexible web therebetween, at least one of said rolls being pressurizably biased toward the other roll;

a splice detector for sensing passage of a splice in said web;

a counter which is activated upon passage of a splice past said detector; said counter comprising a means for relieving said pressurizable bias;

said splice detector comprising a photo-electirc control unit;

said counter also comprising a rotatable member having an array of evenly spaced circumferentially disposed holes near its periphery, said holes in said rotatable member being counted by a counter mechanism, whereby counting of a predetermined number of holes in said rotatable member indicates that a predetermined length of web has traveled from said splice detector to the vicinity of said rolls, and said mechanism for relieving said pressurizable bias is activated, and for counting a predetermined number of holes in said rotatable member after said pressurizable bias is relieved, indicating passage of said splice between said rolls, said mechanism thereafter effects said pressurizable bias restoring a pressurizable nip to said traveling web; and said counter including a fiber-optic apparatus to count the number of hole moving therepast said rotatable member.

* * * * *